US006647122B1

(12) United States Patent
Jones

(10) Patent No.: US 6,647,122 B1
(45) **Date of Patent: *Nov. 11, 2003**

(54) LOUDSPEAKER DRIVE UNIT

(75) Inventor: Andrew Jones, West Hollywood, CA (US)

(73) Assignee: Pioneer Electronics Technology, Inc., Pomona, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/375,238

(22) Filed: Aug. 16, 1999

Related U.S. Application Data

(60) Provisional application No. 60/101,994, filed on Sep. 28, 1998.

(51) Int. Cl.[7] ..... H04R 25/00

(52) U.S. Cl. ..... 381/182; 381/186; 181/144; 181/152

(58) Field of Search ..... 381/182, 184, 381/186, 342, 423, 424, 426, 432, 398, FOR 153; 181/148, 152, 157, 164, 171, 172

(56) References Cited

U.S. PATENT DOCUMENTS

| | | | | | |
|---|---|---|---|---|---|
| 2,231,479 | A | * | 2/1941 | Perry | 381/424 |
| 2,699,472 | A | * | 1/1955 | Olson et al. | 381/182 |
| 3,213,209 | A | * | 10/1965 | Doelitzsch | 381/424 |
| 3,796,839 | A | | 3/1974 | Torn | 179/116 |
| 3,917,914 | A | | 11/1975 | Parker | 179/115 R |
| 4,174,019 | A | | 11/1979 | Kramer | 181/159 |
| 4,256,930 | A | | 3/1981 | Garner et al. | 179/116 |
| 4,283,606 | A | | 8/1981 | Buck | 179/115.5 H |
| 4,336,861 | A | | 6/1982 | Peter | 181/144 |
| 4,475,014 | A | * | 10/1984 | King | 381/182 |
| 4,492,826 | A | | 1/1985 | Chiu | 179/115.5 PS |
| 4,552,242 | A | | 11/1985 | Kashiwabara | 181/144 |
| 4,554,414 | A | | 11/1985 | House | 179/115.5 PS |
| 4,590,333 | A | | 5/1986 | Strohbeen | 179/115.5 PS |
| 4,619,342 | A | | 10/1986 | Buck | 181/184 |
| 4,727,586 | A | | 2/1988 | Johnson | 381/186 |
| 4,821,330 | A | | 4/1989 | Pfleiderer | 381/184 |
| 4,821,331 | A | | 4/1989 | Murayama et al. | 381/192 |
| 4,914,750 | A | | 4/1990 | Lawson | 381/152 |
| 5,062,139 | A | * | 10/1991 | Christensen | 381/182 |
| 5,339,286 | A | | 8/1994 | Esposto | 367/140 |
| 5,398,288 | A | | 3/1995 | Kizak | 381/186 |
| 5,418,336 | A | | 5/1995 | Negishi et al. | 181/155 |
| 5,526,456 | A | | 6/1996 | Heinz | 381/156 |
| 5,548,657 | A | | 8/1996 | Fincham | 381/182 |
| 5,739,480 | A | * | 4/1998 | Lin | 381/182 |
| 6,219,432 | B1 | * | 4/2001 | Fryer et al. | 381/398 |

* cited by examiner

*Primary Examiner*—Curtis Kuntz
*Assistant Examiner*—Suhan Ni
(74) *Attorney, Agent, or Firm*—Sughrue Mion, PLLC

(57) ABSTRACT

The present invention relates to a compound loudspeaker. In the loudspeaker, the L.F. drive unit has a curved flexible diaphragm whose shape is determined such that it optimally controls the directivity of the compound loudspeaker to produce matched directivity of the L.F. and H.F. drive units. The L.F. diaphragm drive unit radiates sound by the controlled flexure of its diaphragm and thus, eliminates the need for a flexible rolling seal at the edge of the diaphragm. This allows for a continuous smooth surface to exist between the H.F. drive unit and the exterior of the loudspeaker, thereby greatly improving its radiation characteristics.

19 Claims, 2 Drawing Sheets

LOUDSPEAKER DRIVE UNIT

This application claims the benefit of Provisional application Ser. No. 60/101,994, filed Sep. 28, 1998.

FIELD OF THE INVENTION

The present invention relates to a compound loudspeaker drive unit comprising a high frequency (H.F.) drive unit mounted concentrically within a low frequency (L.F.) drive unit.

BACKGROUND OF THE INVENTION

For practical reasons, conventional loudspeakers typically comprise at least an L.F. drive unit and an H.F. drive unit. The two drive units are combined via an electrical or mechanical filter such that each unit is constrained to operate only over its optimum frequency range. In other words, the L.F. drive unit may be constrained to operate only over the low frequency range, and the H.F. drive unit may be constrained to operate only over the high frequency range. However, the low frequency range and high frequency range may overlap at a mid-frequency range such that both units output sound at the mid-frequency range.

Typically, these units are physically separated from each other. For example, they may be mounted adjacent to each other on the front of a loudspeaker cabinet such that the center of the L.F. drive unit is offset by some distance from the center of the H.F. drive unit. However, such separation causes the apparent sound sources or acoustic centers of the L.F. and H.F. drive units not to be equidistant from the listener for all possible positions where the listener may be located. As a result, the loudspeaker undesirably has a sound radiation characteristic that is non-uniform in all directions. For example, when both drive units are simultaneously outputting sound at the mid-frequency range, the distance from the L.F. drive unit to the listener may be different than the distance from the H.F. drive unit to the listener. Consequently, the sounds produced from the L.F. and H.F. drive units will not reach the listener at the same time, and the sound will be non-uniform. The undesirable sound radiation characteristic also results from the fact that the directivity of the L.F. and H.F. drive units are not matched because their sizes and shapes are different. In other words, due to the differences in sizes and shapes, in any particular direction, the sound emitted from the L.F. drive unit may be different than the sound emitted from the H.F. drive unit.

In order to try to overcome the problems above, numerous solutions have been proposed in which the H.F. drive unit is mounted concentrically within the L.F. drive unit. In the most successful of these proposed solutions, the L.F. drive unit is a cone shaped diaphragm, and the H.F. drive unit is mounted at the apex of the L.F. drive unit. Such an arrangement is shown in FIG. 1 which corresponds to a figure of U.S. Pat. No. 5,548,657, which is incorporated herein by reference. In such an arrangement, by virtue of the fact that the shape of the L.F. diaphragm drive unit 21 acts as a waveguide for the sound radiated from the H.F. drive unit 27, the L.F. diaphragm drive unit 21 imposes directivity control upon the radiation of sound from the H.F. drive unit 27. In this manner, substantially matched directivities are achieved throughout the mid-frequency range in which both units contribute significantly to the radiated sound. Additionally, this arrangement is intended to bring both the H.F. drive unit 27 and the L.F. drive unit 21 into time alignment such that the sounds emitted from the L.F. and H.F. drive units 21 and 27 reach the listener at the same time.

The arrangement disclosed in U.S. Pat. No. 5,548,657 and other similar arrangements have several disadvantages. For example, the L.F. diaphragm drive unit 21 is made of a substantially stiff cone. Also, the stiff cone is supported at its outer edge by a flexible rolling seal 22 to allow the axial movement of the L.F. diaphragm drive unit 21 required for sound radiation. As shown in FIG. 1, the necessary shape of this seal 22 interrupts the smooth surface of the L.F. diaphragm drive unit 21 extending from the H.F. drive unit 27 towards the outside of the loudspeaker. As a result, the sound emanating from H.F. drive unit 27 confronts such interruption, and irregularities in the frequency response of the H.F. drive unit 27 occur based upon the location of a listener.

In addition, as mentioned above, placing the H.F. drive unit 27 at the apex of the cone shaped L.F. diaphragm drive unit 21 is intended to bring both units into time alignment. However, the filters typically used to combine the two units add differential delays to the signals applied to those units, therefore disrupting the time alignment achieved by physically positioning the H.F. drive unit at the apex of the cone.

DESCRIPTION OF THE PREFERRED EMBODIMENT(S) OF THE INVENTION

In order to overcome the problems of the compound loudspeakers described above, the present invention employs an L.F. diaphragm drive unit 100 whose shape is configured to present a smooth continuous surface from the H.F. drive unit 101 to the exterior of the loudspeaker while enabling the L.F. diaphragm drive unit 100 to move axially. The axial motion of the L.F. diaphragm drive unit 100 is enabled by allowing the diaphragm itself to flex in a smooth continuous manner by being driven from its inner circumference and being clamped at its outer circumference 102. As a result, the need for a flexible edge seal at the outer circumference 102 is eliminated.

Figure 1:
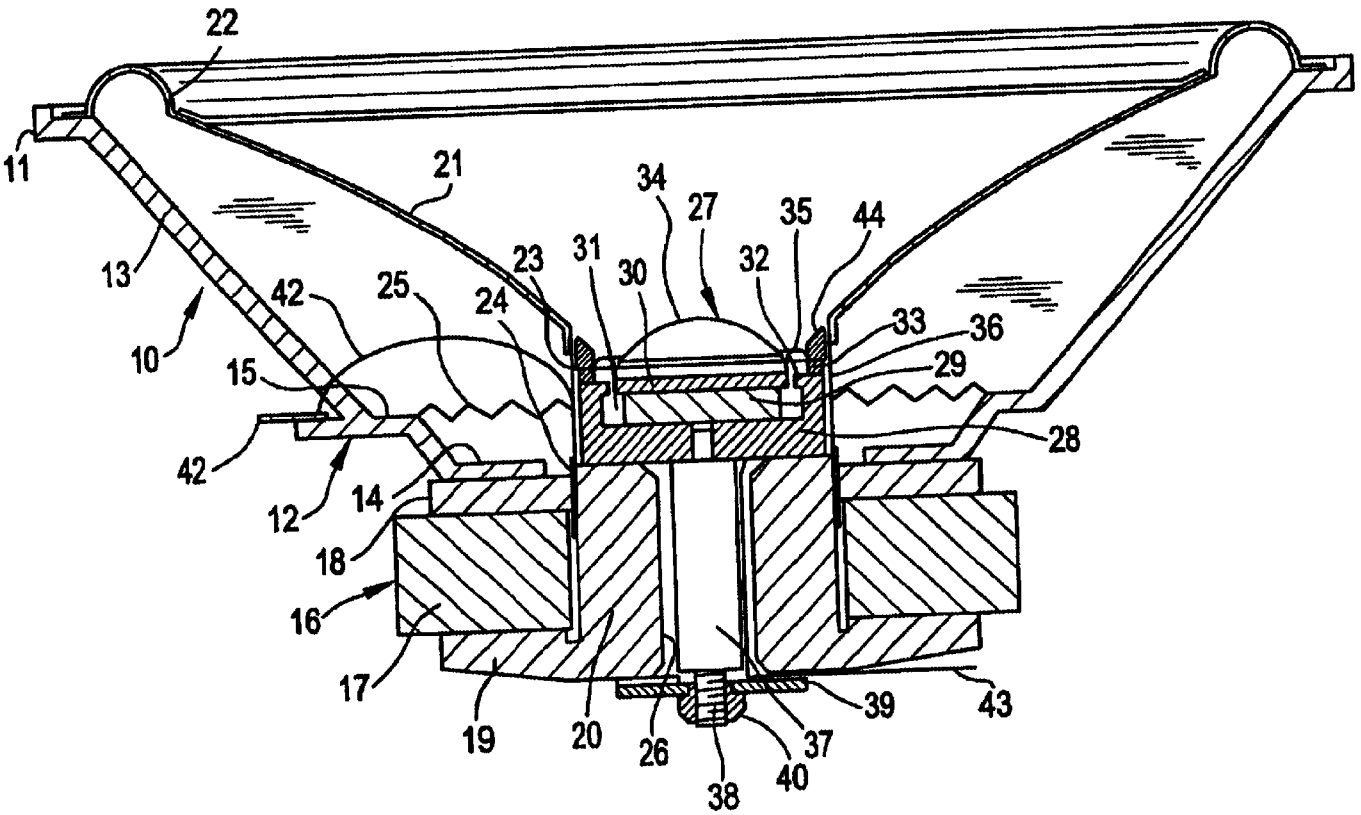
FIG. 1 PRIOR ART
FIG. 1 shows a compound loudspeaker disclosed in U.S. Pat. No. 5,548,657.
Figure 2:
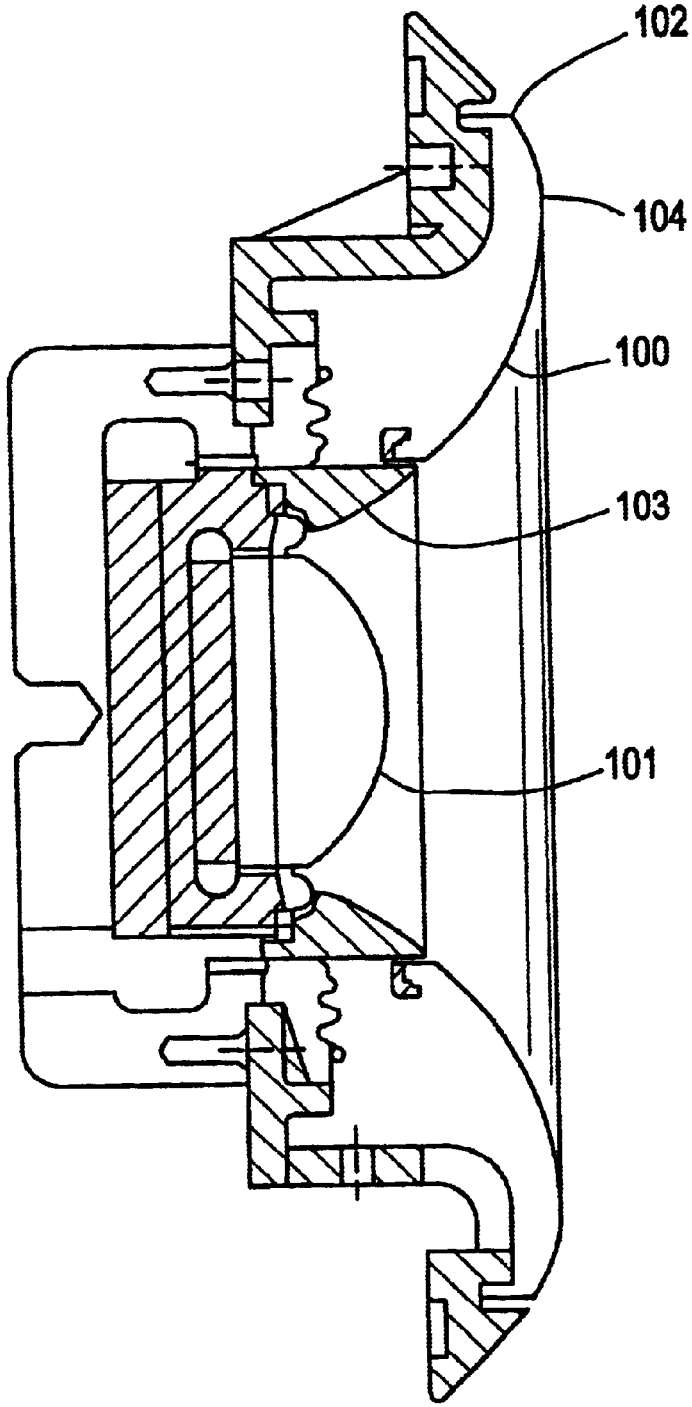
FIG. 2 shows an illustrative embodiment of a compound loudspeaker in accordance with the present invention.

An example of an illustrative embodiment of the invention is shown in FIG. 2. In the figure, the inner circumference of the L.F. diaphragm drive unit 100 is matched to the H.F. drive unit 101 via a short fixed horn 103. The purpose of the horn 103 is to allow the H.F. drive unit 101 to be positioned behind the apex of the L.F. diaphragm drive unit 100. This adds a time delay to the H.F. drive unit 101 by virtue of the finite velocity of the propagation of sound waves. Thus, the horn 103 compensates for the differential time delay imposed by the combing filter and thus, brings the L.F. and H.F. units 100 and 101 substantially back into time alignment. Also, as shown in the figure, no interruptions occur along the smooth surface of the L.F. diaphragm drive unit 100 between the H.F. drive unit 101 and a forward-most point of the drive unit (e.g. the exterior of the speaker). Therefore, no irregularities in the frequency response of the H.F. drive unit 101 occur.

What is claimed is:

1. A loudspeaker drive unit, comprising:

a low frequency drive unit having a low frequency diaphragm for generally radiating sound in a forward direction;

a high frequency drive unit having a high frequency diaphragm disposed concentrically with said low frequency diaphragm; and a horn disposed between said low frequency diaphragm and said high frequency drive unit, wherein an outer surface of said low frequency diaphragm extends from an inner circumference of said low frequency diaphragm to a forward-most point of said low frequency diaphragm in a smooth and continuous manner, wherein said low frequency diaphragm is fixed at an outer circumference of said low frequency diaphragm and said forward-most point is located on said outer surface between said inner circumference of said low frequency diaphragm and said outer circumference of said low frequency diaphragm, and wherein said outer circumference does not move when said low frequency diaphragm is radiating sound.

2. The loudspeaker drive unit as claimed in claim 1, wherein said high frequency drive unit is disposed behind said low frequency diaphragm.

3. The loudspeaker drive unit as claimed in claim 1, wherein said low frequency diaphragm is made of a flexible material that flexes when said low frequency diaphragm is radiating sound.

4. The loudspeaker drive unit as claimed in claim 1, wherein said horn substantially matches said high frequency drive unit with said low frequency diaphragm.

5. The loudspeaker drive unit as claimed in claim 4, wherein an outer circumference of said horn is substantially the same as said inner circumference of said low frequency diaphragm and an inner circumference of said horn is substantially the same as an outer circumference of said high frequency drive unit.

6. The loudspeaker drive unit as claimed in claim 1, wherein sound waves radiated from said high frequency drive unit travel along said outer surface of said low frequency diaphragm.

7. The loudspeaker drive unit as claimed in claim 1, wherein said outer surface of said low frequency diaphragm is curved surface.

8. The loudspeaker drive unit as claimed in claim 7, wherein said outer surface of said low frequency diaphragm is substantially arc-shaped.

9. The loudspeaker drive unit as claimed in claim 1, wherein said outer surface of said low frequency diaphragm extends from said inner circumference to said outer circumference in a smooth and continuous manner.

10. The loudspeaker drive unit as claimed in claim 1, wherein said outer surface of said low frequency diaphragm is substantially arc-shaped from said inner circumference of said low frequency diaphragm to said forward-most point.

11. The loudspeaker drive unit as claimed in claim 10, wherein said outer surface of said low frequency diaphragm is substantially arc-shaped from said inner circumference of said low frequency diaphragm to said outer circumference of said low frequency diaphragm.

12. The loudspeaker drive unit as claimed in claim 1, wherein said horn is a fixed rigid horn.

13. A loudspeaker drive unit, comprising:

a low frequency drive unit having a low frequency diaphragm for generally radiating sound in a forward direction;

a high frequency drive unit having a high frequency diaphragm disposed concentrically with said low frequency diaphragm and disposed behind an apex of said low frequency diaphragm; and a horn that is disposed between said low frequency diaphragm and said high frequency drive unit and that substantially matches said high frequency drive unit with said low frequency diaphragm, wherein an outer surface of said low frequency diaphragm extends from an inner circumference of said low frequency diaphragm to a forward-most point of said low frequency diaphragm in a smooth and continuous manner, wherein said low frequency diaphragm is fixed at an outer circumference of said low frequency diaphragm and said forward-most point is located on said outer surface between said inner circumference of said low frequency diaphragm and said outer circumference of said low frequency diaphragm, and wherein said outer circumference does not move when said low frequency diaphragm is radiating sound.

14. The loudspeaker drive unit as claimed in claim 13, wherein said low frequency diaphragm is made of a flexible material that flexes when said low frequency diaphragm is radiating sound.

15. The loudspeaker drive unit as claimed in claim 14, wherein an outer circumference of said horn is substantially the same as said inner circumference of said low frequency diaphragm and an inner circumference of said horn is substantially the same as an outer circumference of said high frequency drive unit.

16. The loudspeaker drive unit as claimed in claim 15, wherein said outer surface of said low frequency diaphragm is substantially arc-shaped.

17. The loudspeaker drive unit as claimed in claim 13, wherein said horn is a fixed rigid horn.

18. The loudspeaker drive unit as claimed in claim 13, wherein said outer surface of said low frequency diaphragm is substantially arc-shaped from said inner circumference of said low frequency diaphragm to said forward-most point.

19. The loudspeaker drive unit as claimed in claim 18, wherein said outer surface of said low frequency diaphragm is substantially arc-shaped from said inner circumference of said low frequency diaphragm to said outer circumference of said low frequency diaphragm.

* * * * *